United States Patent [19]

Shapiro et al.

[11] 4,426,190

[45] Jan. 17, 1984

[54] VANE PUMP

[76] Inventors: Anatoly S. Shapiro, Raketny bulvar, 12, kv. 7, Moscow; Leonid F. Kalashnikov, ulitsa 50 let VLKSM, 2, kv. 165, Kaliningrad Moskovskoi oblasti; Nikolai I. Leontiev, ulitsa Tereshkovoi, 6, kv. 27, Kaliningrad Moskovskoi oblasti; Vladimir I. Polyakov, ulitsa Ostrovskogo, 5, kv. 8, Kaliningrad Moskovskoi oblasti; Anatoly A. Steblevsky, ulitsa Pionerskaya, 13, kv. 11, Schelkovo Moskovskoi oblasti, all of U.S.S.R.

[21] Appl. No.: 215,400

[22] Filed: Dec. 11, 1980

[51] Int. Cl.[3] ..... F04D 3/02

[52] U.S. Cl. ..... 415/74; 415/143

[58] Field of Search ..... 415/72–74, 415/213 C, 176, 177, 143, 175

[56] References Cited

U.S. PATENT DOCUMENTS

| | | | |
|---|---|---|---|
| 2,407,748 | 9/1946 | Schmidt | 415/72 |
| 3,163,119 | 12/1964 | Huppert et al. | 415/72 |
| 3,299,821 | 1/1967 | Silvern . | |
| 3,384,022 | 5/1968 | Oshima . | |
| 3,723,019 | 3/1973 | Berman . | |
| 4,150,916 | 4/1979 | Tsutsui et al. | 415/143 |
| 4,275,988 | 6/1981 | Kalashnikov et al. | 415/74 |

FOREIGN PATENT DOCUMENTS

| | | | |
|---|---|---|---|
| 1218023 | 1/1971 | United Kingdom . | |
| 1417549 | 12/1975 | United Kingdom . | |
| 1523893 | 9/1978 | United Kingdom . | |
| 158493 | 9/1962 | U.S.S.R. . | |
| 154134 | 7/1963 | U.S.S.R. . | |
| 542022 | 1/1977 | U.S.S.R. . | |
| 547554 | 2/1977 | U.S.S.R. . | |
| 596733 | 3/1978 | U.S.S.R. | 415/72 |
| 1417549 | 12/1975 | United Kingdom . | |
| 1523893 | 9/1978 | United Kingdom . | |

OTHER PUBLICATIONS

"High-Speed Impeller Pumps," edited by B. V. Ovsyannikov, Dr. Techn. Sci., and V. F. Chebayevski, Dr. Techn. Sci., Moscow Mashinostroyeniya (Mechanical Engineering) Publishers, 1975.

Transactions of the ASME, Series D, Journal of Basic Engineering, vol. 84, Series D, No. 3, Sep. 1962.

Centrifugal and Axial Flow Pumps, by A. J. Stepanoff, 2nd Ed., John Wiley & Sons, Inc., pp. 148–153.

*Primary Examiner*—Stephen Marcus

*Assistant Examiner*—Joseph M. Pitko

*Attorney, Agent, or Firm*—Fleit, Jacobson, Cohn & Price

[57] ABSTRACT

The pump comprises a housing (1) in which are installed with a radial clearance an axial-flow suction wheel (5) and an axial-flow impeller wheel (6), which wheels are mounted on a common drive shaft (4) one after the other in the direction of flow. The inside diameter of the pump housing (1) in the zone of the suction wheel (5) decreases in the direction of flow. The inside diameter of the pump housing at the entry to the suction wheel (5) is calculated from the formula:

$$D_o = D_1 \cdot K_1 (C_k \cdot 10^{-4} + 2.1)^2$$

The suction wheel (5) comprises a hub (11) with helical vanes (12) attached thereto. The vane setting angle increases in the direction of flow and at the entry to the suction wheel (5) it is:

$$\beta_o = (10 \text{ to } 33\Delta/D_1)^\circ \pm 1.5,$$

where $D_o$—inside diameter of the pump housing 1 at the entry to the suction wheel 5;

$D_1$—inside diameter of the pump housing 1 at the entry to the impeller wheel 6;

$K_1$—dimensionless coefficient of 0.17 to 0.13;

$C_k$—predetermined cavitation critical speed coefficient of 5,000 to 10,000;

$\Delta$—radial clearance.

1 Claim, 5 Drawing Figures

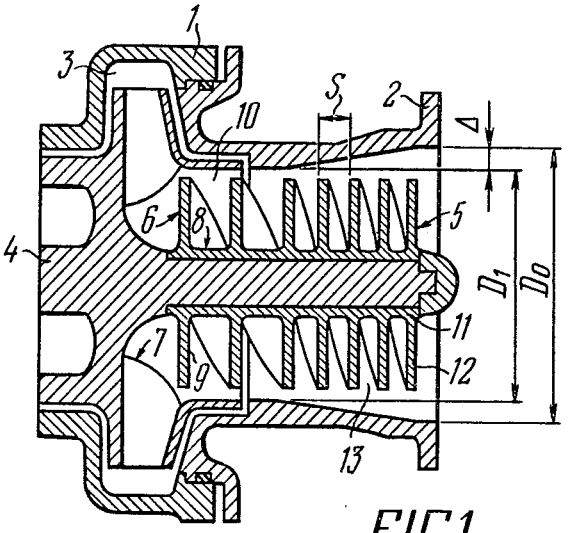
FIG.1
FIG.2
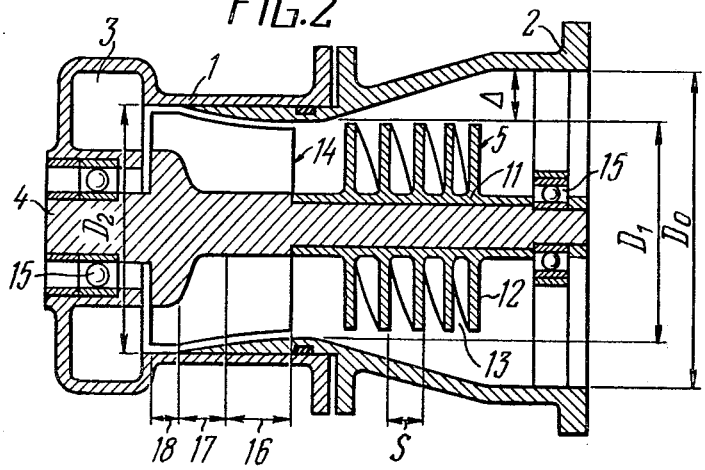

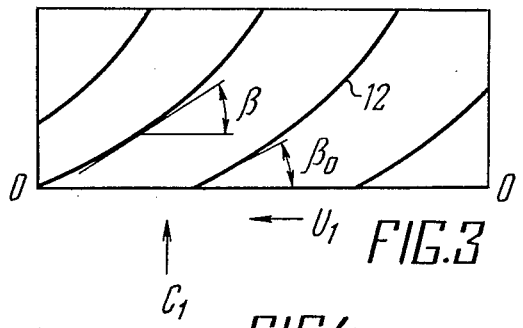
FIG.3
FIG.4
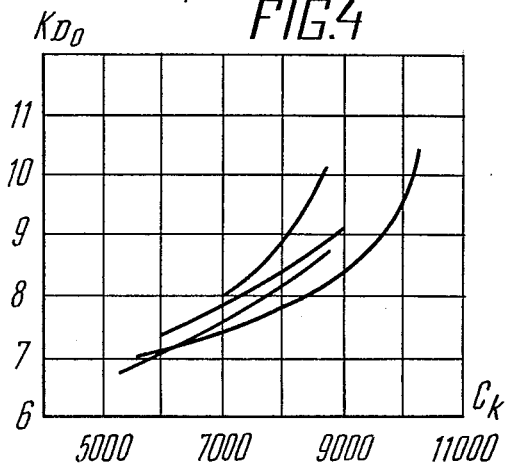
FIG.5
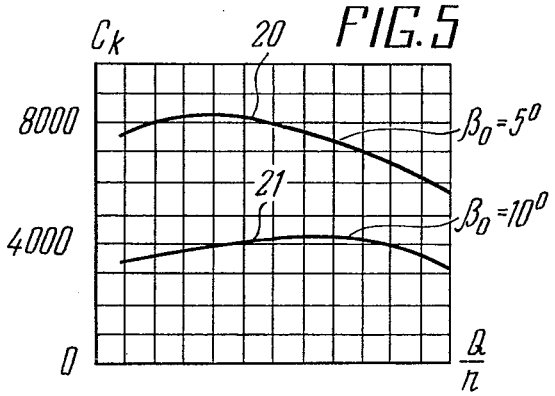

VANE PUMP

TECHNICAL FIELD

The invention relates to pump engineering and has particular reference to vane pump.

BACKGROUND OF THE INVENTION

One of the most important characteristics of pumps is suction capacity expressed by the cavitation critical speed coefficient:

$$C_k = 5.62 \frac{n\sqrt{Q}}{\Delta h^{\frac{3}{4}}}, \quad (1)$$

where n—drive shaft rotational speed, in revolutions per minute;

Q—volumetric rate of flow of the liquid being pumped, i.e. pump output, in cubic meters per second;

Δh—net positive suction head, in meters.

The greater the coefficient $C_k$, the greater the pump suction capacity.

The rotational speed of the pump drive shaft determines the size and mass of the pump, whereas the pump output and the suction capacity determine, respectively, the quantity of the pumps required for the given job and the capital outlay. For example, doubling the pump suction capacity, with unchanged suction head, enables doubling the rotational speed of the pump drive shaft, whereby the pump size and mass can be decreased twice or thrice, making for substantial reduction of pump manufacturing costs. The current trend toward increase in the capacity of single power units calls for further increase in pump output with consequent increase in suction head. In high output pumps, increasing suction head is restrained by cost considerations. On the other hand, increasing pump suction capacity, for example, twice, makes it possible to use one large-output pump instead of four pumps with an equivalent total output and to decrease suction head outlay at least thrice.

Thus, there is a great need in pump engineering for increasing pump suction capacity.

Insufficient suction capacity of a pump causes cavitation with resultant decrease in head and efficiency.

The specific point of the problem is that increase in the suction capacity of a pump is usually accompanied by decrease in the pump efficiency $\eta$, which causes substantial increase in power consumption. Therefore, as a rule, pumps with high suction capacity have low efficiency, whereas pumps with high efficiency have low suction capactiy.

Known in the art are pumps with high suction capacity ($C_k \approx 4{,}000$) ("Kavitatsia v lopastnykh nasosakh", by Stripling, Tr. ASME, Ser. DN 3, 1962/in Russian/).

Such a pump comprises an axial-flow impeller wheel which is mounted on a drive shaft and has a hub with helical vanes attached thereto. The vanes are profiled along the wheel radius according to the expression $r.tg\beta = cost$, where r is the current value of the radius of the axial-flow wheel and $\beta$ is the vane setting angle between the plane normal to the pump drive shaft and the plane tangential to the vanes.

The suction capacity of this pump is increased by virtue of increasing the cross-sectional area of the pump flow duct and decreasing the vane angle, which results in decrease of the wheel entry velocity ratio $\phi$, i.e. the ratio of the axial velocity $C_1$ of the liquid flow to the peripheral velocity $U_1$ of the pump wheel on the outside diameter thereof. Increase in the cross-sectional area of the pump flow duct is achieved by increasing the outside diameter of the pump wheel and by decreasing the hub diameter as much as possible with respect to strength considerations. This solution ensures decrease in the axial component of the liquid flow velocity and provides the minimum drop of static pressure in the liquid flow, whereby the suction capacity of the pump is increased.

However, this pump has a low efficiency ($\eta = 0.5$) inasmuch as the velocity ratio is low ($\phi < 0.1$) due to increase in the cross-sectional area of the pump flow duct, decrease in the axial velocity $C_1$ of the liquid flow, and breakaway nature of flow through the wheel.

Known in the art are vane pumps with the efficiency $\eta$ as high as 0.75 to 0.9. "Tsentrobezhnye i osevye nasosy" by A. J. Stepanov, "Mashgis" publishers, Moscow, 1960, pp. 141–164/in Russian/).

Such a pump comprises a housing which accommodates an impeller wheel mounted on a drive shaft and having a hub with vanes attached thereto. The developments of the cylindrical sections of said vanes form a cascade of airfoils set at relatively large angles between the airfoil chord and the cascade front, said angles being suitable for an increased velocity ratio ($\phi > 0.2$).

However, this pump has a substantially low suction capacity ($c_k \approx 1{,}000$) in connection with relatively high axial velocities $C_1$ of the liquid flow due to decrease in the cross-sectional area of the impeller wheel flow duct.

Known in the art are pumps with high suction capacity $C_k$ is as large as 5,200 to 4,200 (See, for example, "Vysokooborotnye lopatochnye nasosy" by B. J. Borovsky, N. S. Ershov, B. V. Ovsyannikov, V. J. Petrov, V. F. Chebaevsky, A. S. Shapiro, "Mashinostroenie" publishers, Moscon, 1975, p. 13, FIG. 5 p. 202/in Russian/) and pumps with a relative suction velocity $S_s$ of 40,000 to 60,000, where $S_s = 9.19\ C_k$ (see, for example, Barham H. Lee Application of waterjet propulsion to high-performance boats, "Hover Craft and Hydrofoil", 1976, 15, N 9, pp. 33–43). In these pumps, in order to provide high suction capacity, use is made of an axial-flow wheel mounted on a drive shaft together with an impeller wheel. The axial-flow wheel is highly immune to cavitation and develops a head sufficient to provide for cavitation-free operation of the impeller wheel.

In the pumps of the prior art use is made of the following means in order to increase suction capacity:

a worm with a lengthwise variable pitch (USSR Inventor's Certificate no. 154, published in Bull. "Discoveries, Inventions, Industrial Designs and Trademarks", No. 8 of April, 1963, p. 71).

a taper worm mounted in a confuser (British patent No. 1,218,023, published in July 28, 1968, WEIR Pumps L.T.D.).

a worm with a taper hub, variable diameter and blade pitch, and an entry rake;

an upstream, axial-flow, converging wheel with a taper shroud (USSR Inventor's Certificate No. 158493, published in Bull. "Discoveries, Inventions, Industrial Designs and Trademarks", No. 21 of November 1963, p. 76).

a worm in the form of an axially movable helix (USSR Inventor's Certificate No. 542022 published in Bull. "Discoveries, Inventions, Industrial Designs and Trademarks" No. 1 of 1977, p. 151).

an upstream taper wheel with a helical thread on the outer surface (USSR Inventor's Certificate No. 547554, published in Bull. "Discoveries, Inventions, Industrial Designs and Trademarks", No. 7 of 1977, p. 92).

an inlet device installed before a centrifugal wheel and comprising several rows of vanes gradually increasing in diameter;

an upstream, axial-flow wheel the estimated rate of flow through which is three times greater than that through a centrifugal wheel (U.S. Pat. No. 3,384,022, published in May of 1968, Ebara Manufacturing Co LTD. Japan).

a conical hub changing into a radial-flow wheel, which hub mounts several circular rows of round-section pins installed at a varying angle to the axis of rotation (British Pat. No. 1,417,549, published Dec. 10, 1975, Lucas Industries LTD).

an upstream, single- or multiple-start worm or a conical, ribbed head (DE Application No. 2545736, published in Apr. 25, 1977, Blum, Albert).

an upstream, double-stage, axial-flow wheel wherein the vanes of each stage have different diameter and angle of pitch (British Application No. 1,523,893, published Sept. 6, 1978, Nikkiso Co LTD, Japan).

an upstream, axial-flow wheel with a bypass device for recirculating fluid in the zone of a worm (U.S. Pat. No. 3,723,019, published Mar. 27, 1973, Worthigton Corporation).

The pump constructions considered above do not provide for the maximum possible increase in action capacity. Furthermore, while improving some parameters, for example, cavitation characteristics, they impair others, for example, pump efficiency or stability.

Known in the art is a vane pump (U.S. Pat. No. 3,299,821, 103-88, published Jan. 24, 1967, assignor to Sundstrand Corporation, a corporation of Illinois) comprising a housing and two axial-flow wheels, viz. a suction wheel and an impeller wheel, which are mounted on a common drive shaft and installed with a radial clearance in the housing. The suction wheel has a hub with helical vanes attached thereto, the pitch of the vanes increasing in the direction of flow.

The vane pitch on the suction wheel is chosen so as to provide high suction capacity of the pump, whereas the vane pitch on the impeller wheel is chosen so as to provide the required head and increase pump efficiency. The pump operates as follows. The liquid first enters the axial-flow suction wheel. As the flow passes over the vanes, cavitation originates and develops. At the end of the suction wheel the cavitation ceases. After the suction wheel the liquid, which has acquired some energy, enters the axial-flow impeller which creates, in the main, the required head. The pump under consideration provides high suction capacity ($C_k=3{,}000$) and an increased efficiency, but these parameters are not at a maximum inasmuch as the radial clearance of the axial-flow wheels and its relation to the wheel geometry are not stipulated.

The technical solutions described above merely disclose the level achieved in the prior art in the endeavor to provide for a pump to have both high suction capacity and high efficiency, which level is, of course, not at the utmost.

DISCLOSURE OF THE INVENTION

It is an object of the present invention to device a pump with a specially profiled inlet duct wherein the inside diameter varies according to the geometrical dimensions of the axial-flow wheel involved, thereby increasing the suction capacity of the pump and also improving the energy characteristics thereof.

The invention provides a vane pump comprising a housing wherein an axial-flow suction wheel and an axial-flow impeller wheel are installed with a radial clearance, which suction and impeller wheels are mounted on a common drive shaft one after the other in the direction of flow. The suction wheel comprises a hub with helical vanes of varying pitch attached thereto. The inside diameter of the pump housing in the zone of the suction wheel decreases in the direction of flow. The vanes of the suction wheel have a varying angle of setting at the tip, said angle increasing in the direction of flow. The inside diameter of the pump housing at the entry to the suction wheel is chosen according to:

$$D_o=D_1\cdot K_1(C_k\cdot 10^{-4}+2.1)^2, \quad (2)$$

where $D_o$—inside diameter of the pump housing at the entry to the suction wheel;

$D_1$—inside diameter of the pump housing at the entry to the impeller wheel;

$K_1$—dimensionless coefficient of 0.17 to 0.13;

$C_k$—predetermined cavitation critical speed coefficient of 5,000 to 11,000.

The vane tip setting angle of the suction wheel at the entry thereto is determined by:

$$\beta_o=(10 \text{ to } 33\ \Delta/D_1)^\circ\pm 1.5^\circ, \quad (3)$$

where $\beta_o$—vane tip setting angle of the suction wheel at the entry thereto;

$\Delta$—radial clearance at the entry to the suction wheel;

$D_1$—inside diameter of the pump housing at the entry to the impeller wheel.

The constructional solution described above provides for substantial increase of pump suction capacity. This is attributed to the provision of an increased radial clearance between the outside diameter of the axial-flow suction wheel and the inside diameter of the pump housing, due to which the liquid flow at the entry to the suction wheel is divided into two flows one of which passes through the clearance and the other through said wheel.

By reference to the relation (1) we find that at a given pump drive shaft speed and a given cavitation critical speed coefficient a lesser net positive suction head is required to provide for cavitation-free operation of the axial-flow suction wheel at a decreased volumetric rate of flow through the pump. With respect to the pump as a whole, decrease in the required net positive suction head at a given volumetric rate of flow and a given pump drive shaft speed results in substantial increase of pump suction capacity.

BRIEF DESCRIPTION OF THE DRAWINGS

The invention will now be more particularly described by way of example with reference to the accompanying drawings, wherein:

FIG. 1 is a longitudinal sectional view of an embodiment of the axial-radial flow vane pump according to the invention.

FIG. 2 is a longitudinal sectional view of an embodiment of the axial-diagonal flow vane pump according to the invention.

FIG. 3 is a development of the cylindrical section of the axial-flow suction wheel according to the invention.

FIG. 4 is a graph showing the coefficient of the pump housing diameter at the entry to the axial-flow suction wheel versus the cavitation critical speed coefficient according to the invention.

FIG. 5 is a graph showing the cavitation critical speed coefficient versus specific rate of flow at two vane setting angles on the suction wheel as obtained in testing the pump embodiment of FIG. 1.

BEST MODE FOR CARRYING OUT THE INVENTION

The vane pump comprises a housing 1 (FIG. 1) which, in this embodiment, is made in two pieces, viz. an inlet 2 and a scroll outlet 3. The housing 1 accommodates a drive shaft 4 mounted on which one after the other in the direction of flow are an axial-flow suction wheel 5, an axial-flow impeller wheel 6 and a radial-flow wheel 7. The impeller wheel 6 has a hub 8 to which are attached helical vanes 98 forming intervane passages 10 for the flow of liquid. The suction wheel 5 comprises a hub 11 to which are attached helical vanes 12 forming intervane passages 13. The vanes 12 on the suction wheel 5 have varying pitch which increases in the direction of flow.

The symbols used in FIGS. 1 and 2 have the following significance:

S—pitch of helix of the vane 12 on the suction wheel 5;

$D_1$—inside diameter of the housing 1 (in this case of the inlet 2) at the entry to the impeller wheel 6;

$D_o$—inside diameter of the housing 1 at the entry to the suction wheel 5;

Δ—radial clearance at the entry to the suction wheel 5.

In another embodiment of the pump the axial-flow suction wheel 5 is used in conjunction with an axial-diagonal flow wheel 14 (FIG. 2) and the drive shaft 4 is mounted in bearings 15 installed in the housing 1. The axial-diagonal flow wheel 14 consists of three portions, viz. an inlet axial-flow portion 16 which forms a cavitation part, a diagonal portion 17 which forms a delivery part, and an outlet axial-flow portion 18 which forms a straightening part. The inlet axial-flow portion 16 of the axial-diagonal flow wheel 14 fulfils the same function as the axial-flow impeller wheel 6 (FIG. 1) and the entry to the wheel 14 is considered the same as the entry to the wheel 6. The inside diameter of the pump housing 1 varies in the direction of flow from the maximum diameter $D_o$ at the entry to the suction wheel 5 to the minimum diameter $D_1$ at the entry to the axial-diagonal flow wheel 14 and then to the diameter $D_2$ at the entry to the outlet 3.

The setting angle $\beta$ (FIG. 3) of the vanes 12 (FIG. 1) on the suction wheel 5 is formed between the plane normal to the axis of rotation of the wheel 5 and the plane tangential to the vane 12 of the wheel 5. The direction of the axial velocity of the flow is indicated by the arrow $C_1$ (FIG. 3). The direction of the peripheral velocity of the wheel 5 (FIG. 1) is indicated by the arrow $U_1$ (FIG. 3).

The graph in FIG. 4 shows experimental curves for the coefficient $K_{Do}$ of the pump housing diameter at the entry to the axial-flow suction wheel 5 (FIG. 1) versus the cavitation critical speed coefficient $C_k$ for four pumps.

$$K_{Do} = \frac{D_o}{\sqrt[3]{\frac{Q}{n}}}, \tag{4}$$

where $D_o$—inside diameter of the pump housing at the entry to the suction wheel 5;

Q—rate of flow through the pump;

n—rotational speed of the drive shaft 4.

The graph in FIG. 5 shows the cavitation critical speed coefficient $C_k$ versus the specific rate of flow Q/n.

The curve 20 is obtained in testing the pump embodiment depicted in FIG. 1 and relates to the angle $\beta_o$ (FIG. 3) of the vanes 12 (FIG. 1) equal to 5°. The curve 21 is for the angle $\beta_o$ (FIG. 3) equal to 10°.

The vane pump operates as follows.

When the drive shaft 4 (FIG. 1) rotates, the liquid being pumped passes through the inlet 2 of the pump housing 1 into the rotating suction wheel 5. A part of the liquid goes through the intervane passages 13, whilst the other part enters the rotating impeller wheel 6 through the clearance Δ between the pump housing 1 and the vanes 12 of the suction wheel 5. The power interaction between the vanes 12 and the liquid causes rise in the liquid pressure. The liquid proceeds into the impeller wheel 6 wherein it goes through the intervane passages 10. The power interaction between the vanes 9 and the liquid causes further pressure rise and the liquid thereafter enters the radial-flow wheel 7. From the intervane passages 10 of the impeller wheel 6 the liquid goes into the radial-flow wheel 7 wherein the liquid pressure is raised to the required value. The successive build-up of the liquid pressure ensures cavitation-free operation of each of the pump wheels 5, 6 and 7. From the radial-flow wheel 7 the liquid proceeds into the outlet 3 and thence into a delivery line (not shown).

The pump depicted in FIG. 2 operates substantially in the same manner as that in FIG. 1.

On the basis of theoretical and experimental data obtained for several pumps constructed according to the embodiments shown in FIGS. 1 and 2 relationship is found between the geometrical dimensions of the constructional elements determining the coefficient $K_{Do}$ (FIG. 4) of the diameter of the pump housing 1 (FIG. 1) and the cavitation critical speed coefficient $C_k$ (FIG. 4) determining the required suction capacity of the pump.

For pumps with a superhigh suction capacity, the coefficient $K_{Do}$ of the diameter of the housing 1 (FIG. 1) should be chosen according to the experimental curves depicted in FIG. 4. This graphical relationship can be approximately represented in an analytical form:

$$K_{Do} = a \cdot (C_k \cdot 10^{-4} + 2.1)^2, \tag{5}$$

where a=0.85 to 1.15 according to variation in the curves of FIG. 4.

To provide for a superhigh suction capacity at the entry to the suction wheel 5 (FIG. 1), the diameter $D_o$ of the housing 1 at this point should be found from:

$$D_o = a \cdot (C_k \cdot 10^{-4} + 2.1)^2 \cdot \sqrt[3]{\frac{Q}{n}}, \quad (6)$$

where a=0.85 to 1.15.

It is known that the pumps having a high suction capacity have a relatively low efficiency ($\eta$=0.5 to 0.65) because of low velocity ratio ($\phi$<0.1) due to increase in the cross-sectional area of the flow duct, decrease in the flow axial velocity, and a breakaway nature of the flow through the pump wheel.

According to the invention, the efficiency of a pump with a high suction capacity is to be increased by decreasing the inside diameter of the pump housing 1 in the direction of flow from the value $D_o$ calculated by the formula (6) to the value $D_1$ found from:

$$D_1 = K_{D1} \cdot \sqrt[3]{\frac{Q}{n}}, \quad (7)$$

where $K_{D1}$=6 to 7—coefficient of the diameter of the housing 1 at the entry to the axial-flow wheel 7 which provides for increase in efficiency.

From the formulas (6) and (7) we find the relation between the inside diameters of the pump housing 1 which provides for the maximum suction capacity of the suction wheel 5 and the maximum efficiency of the impeller wheel 6:

$$D_o/D_1 = K_1(C_k \cdot 10^{-4} + 2.1)^2, \quad (8)$$

where $K_1$=0.17 to 0.13.

In this case increase in the pump suction capacity is attributed firstly to increase in the cross-sectional area of the flow duct and, consequently, decrease in the velocity ratio $\phi$ at the entry to the suction wheel 5 ($\phi$ is the ratio of the axial flow velocity $C_1$ to the peripheral velocity $U_1$ of the wheel 5). This provides for decrease of the axial component of the flow velocity and for the minimum drop of static pressure in the flow, thereby bringing about increase in the pump suction capacity.

Secondly, increase in the pump suction capacity is attributed to increase of the radial clearance $\Delta$ between the outside diameter of the axial-flow suction wheel 5 and the inside diameter of the housing 1, due to which the flow at the entry to the axial-flow suction wheel 5 is divided into two flows, one of which passes through said clearance $\Delta$ and the other through said wheel 5.

It follows from the formula (1) that, with a given rotational speed of the pump drive shaft 4 and a given cavitation critical speed coefficient $C_k$, the net positive suction head $\Delta h_k$ is to be decreased in order to provide cavitation-free operation of the axial-flow suction wheel 5 at a decreased volumetric rate of flow. As to the pump as a whole, decrease in the required net suction head at a given volumetric rate of flow and a given rotational speed of the pump drive shaft 4 brings about increase in the pump suction capacity.

It follows from the theory of perfect fluid flow about a cascade of infinitely thin plates that the smaller the setting angle $\beta_o$ (FIG. 3) of the vane 12, the better the anticavitation properties of the suction wheel 5 (FIG. 1):

$$\Delta h_k = \frac{C_1 \cdot U_1 \, tg\beta_o}{2}, \quad (9)$$

where $C_1$—axial flow velocity at the entry to the wheel;

$U_1$—wheel peripheral speed;

$\beta_o$—vane setting angle at the entry;

$\Delta h_k$—net positive suction head.

The experiments of the prior art have shown that in the case of pumps with high anticavitation properties, in which upstream worms have small vane setting angles ($\beta \leqq 20°$) the parameter $\beta$ has practically no effect on pump cavitation characteristics if the diameters of the worm and housing are constant (refer, for example, to "Cavitation Characteristics of High-speed Worm and Radial Wheel Pumps" by V. F. Chebotaryov and V. I. Petrov, published in 1973 by "Mashinostroyeniye" Publishers, Moscow, pages 117–118). In these experiments the values of the clearance $\Delta$(FIG. 1) between the worm and the housing were small.

Inasmuch as in the pump of the present invention the suction wheel 5 has a constant diameter, increase in the diameter of the housing 1 results in formation of a relatively large clearance $\Delta$ between the suction wheel 5 and the housing 1. In this case, according to the experimental data presented in FIG. 5, decrease of $\beta_o$ (FIG. 3) makes it possible to substantially increase the cavitation critical speed coefficient $C_k$. The coefficient $C_k$ thus obtained is 8,000 as compared with the initial figures of 4,000 to 5,000.

The experiments with various values of the vane angle $\beta_o$ (FIG. 3) and the clearance $\Delta$(FIG. 1) have provided for finding the optimum relation therebetween with the view of bringing pump suction capacity to a maximum:

$$\beta = (10 \text{ to } 33 \; \Delta/D_1)^\circ \pm 1.5, \quad (10)$$

where $\beta$—vane setting angle on the suction wheel 5;

$\Delta$—radial clearance between the outside diameter of the suction wheel 5 and the inside diameter of the pump housing 5;

$D_1$—inside diameter of the pump housing 1 at the entry to the impeller wheel 6.

The experimental curves in FIG. 4 are obtained with pumps, wherein, according to the formula (10), the radial clearance $\Delta$ (FIG. 1) at the entry to the suction wheel 5 is large, whereas the angle $\beta$ (FIG. 3) of the vanes 12 (FIG. 1) is small.

Dimensioning the housing 1 and the axial-flow suction wheel 5 according to the formulas (8) and (10) provides for obtaining a cavitation coefficient $C_k$ of 6,000 to 10,000 at an efficiency $\eta$ as high as 0.6 to 0.8.

INDUSTRIAL APPLICABILITY

The invention can be used in chemical and petroleum processing industries, melioration and other applications.

The invention can be used with particular advantage in power engineering, shipbuilding, and aerospace technology, more specifically, in high—output pumps with low suction head or in high—speed pumps.

We claim:

1. A vane pump comprising a convergent housing which accommodates an axial-flow suction wheel and a main axial-flow wheel installed in said housing, said suction wheel having a varying radial clearance with said housing, and said wheels mounted one after the other in the direction of flow on a common drive shaft, said suction wheel having a hub with helical vanes attached thereto that increase in pitch in the direction of flow, characterized in that the inside diameter of the pump in the inlet section of the axial-flow suction wheel has a diameter that decreases in the direction of flow from a maximum value to a minimum value at the inlet section of the main axial-flow wheel and equal to the inlet diameter of the main axial-flow wheel, the radial clearance between the housing and the axial-flow suction wheel being maximum at the inlet thereof and diminishing along the suction wheel to a minimum value substantially equal to zero at the inlet section of the main axial-flow wheel, the maximum value of the inside diameter ($D_o$) of the pump housing being chosen according to:

$$D_o = D_1 \cdot K_1 (C_k \cdot 10^{-4} + 2.1)^2,$$

where $D_o$—inside diameter of the pump housing at the inlet section of the suction wheel;

$D_1$—inside diameter of the pump housing at the inlet section of the main axial-flow wheel;

$K_1$—dimensionless coefficient of 0.17 to 0.13

$C_k$—predetermined cavitation critical speed coefficient to 5,000 to 11,000;

and the setting angle ($\beta_o$) of the tip of the vane in the inlet section of the axial-flow suction wheel is minimal and determined according to:

$$\beta_o = (10 = 33\Delta/D_1)^\circ + 1.50,$$

where $\beta_0$—setting angle of the tip of the vane in the inlet section of the axial-flow suction wheel;

$\Delta$—radial clearance in the inlet section of the axial-flow suction wheel;

$D_1$—inside diameter of the pump housing in the inlet section of the impeller wheel.

* * * * *